US009022642B2

(12) United States Patent
Broome

(10) Patent No.: US 9,022,642 B2
(45) Date of Patent: May 5, 2015

(54) DISSOLUTION GENERATOR, METHOD OF DISSOLVING POWDER, AND MIXING SYSTEM

(76) Inventor: Hubert Ray Broome, Cornelius, NC (US)

( * ) Notice: Subject to any disclaimer, the term of this patent is extended or adjusted under 35 U.S.C. 154(b) by 636 days.

(21) Appl. No.: 13/458,113

(22) Filed: Apr. 27, 2012

(65) Prior Publication Data

US 2012/0273585 A1 Nov. 1, 2012

Related U.S. Application Data

(60) Provisional application No. 61/480,013, filed on Apr. 28, 2011.

(51) Int. Cl.

| | |
|---|---|
| ***B01F 3/12*** | (2006.01) |
| ***B01F 5/20*** | (2006.01) |
| ***B01F 1/00*** | (2006.01) |
| *B05B 3/06* | (2006.01) |

(52) U.S. Cl.
CPC ..... *B01F 1/0033* (2013.01); *B01F 1/0027* (2013.01); *B05B 3/06* (2013.01)

(58) Field of Classification Search
CPC ..... B01F 1/0033; B01F 1/0027; B05B 3/06
USPC ..... 366/167.1
See application file for complete search history.

(56) References Cited

U.S. PATENT DOCUMENTS

| | | | | |
|---|---|---|---|---|
| 2,083,076 | A | | 6/1937 | Mau |
| 2,906,607 | A | | 9/1959 | Jamison |
| 3,036,739 | A | | 5/1962 | Kamysz, Jr. |
| 3,574,561 | A | * | 4/1971 | Nickerson ..... 422/106 |
| 3,595,438 | A | | 7/1971 | Daley et al. |
| 3,607,105 | A | | 9/1971 | Reid et al. |
| 3,752,446 | A | | 8/1973 | Watanabe |
| 4,020,865 | A | | 5/1977 | Moffat et al. |
| 4,023,778 | A | * | 5/1977 | Joly et al. ..... 366/165.1 |
| 4,063,663 | A | | 12/1977 | Larson et al. |
| 4,293,914 | A | | 10/1981 | Van Trang |
| 4,462,511 | A | | 7/1984 | Fulmer et al. |
| 4,462,967 | A | | 7/1984 | Berelson |
| 4,687,121 | A | | 8/1987 | Copeland |
| 4,816,222 | A | | 3/1989 | Fagrell |
| 4,826,661 | A | | 5/1989 | Copeland et al. |
| 4,836,229 | A | | 6/1989 | Lakhan et al. |
| 4,858,449 | A | | 8/1989 | Lehn |
| 4,938,240 | A | | 7/1990 | Lakhan et al. |
| 5,007,559 | A | | 4/1991 | Young |
| 5,253,937 | A | | 10/1993 | Scheimann et al. |

(Continued)

FOREIGN PATENT DOCUMENTS

| | | |
|---|---|---|
| EP | 0058507 | 11/1984 |
| EP | 0231603 | 6/1990 |

(Continued)

*Primary Examiner* — Tony G Soohoo
(74) *Attorney, Agent, or Firm* — Trego, Hines & Ladenheim, PLLC

(57) ABSTRACT

A dissolution generator includes: an upright housing; a screen assembly extending across an interior of the housing, and configured to support a column of powder thereabove; a spray nozzle disposed below the screen assembly and directed towards the screen assembly; and a pressure mechanism disposed above the screen assembly, and configured to apply a substantially constant downward pressure.

24 Claims, 10 Drawing Sheets

(56) References Cited

U.S. PATENT DOCUMENTS

| | | | |
|---|---|---|---|
| 5,374,119 | A | 12/1994 | Scheimann |
| 5,389,344 | A | 2/1995 | Copeland et al. |
| 5,393,502 | A | 2/1995 | Miller et al. |
| 5,411,716 | A | 5/1995 | Thomas et al. |
| 5,427,748 | A | 6/1995 | Wiedrich et al. |
| 5,439,020 | A | 8/1995 | Lockhart |
| 5,472,674 | A | 12/1995 | Rings et al. |
| 5,505,223 | A | 4/1996 | Rings et al. |
| 5,505,915 | A | 4/1996 | Copeland et al. |
| 5,607,651 | A | 3/1997 | Thomas et al. |
| 5,655,563 | A | 8/1997 | Johnson |
| 5,678,593 | A | 10/1997 | Lockhart |
| 5,681,109 | A | 10/1997 | Palmer |
| 5,685,640 | A | 11/1997 | Goedicke et al. |
| 5,713,384 | A | 2/1998 | Roach et al. |
| 5,765,945 | A | 6/1998 | Palmer |
| 5,928,608 | A | 7/1999 | Levesque et al. |
| 5,947,596 | A | 9/1999 | Dowd |
| 6,186,657 | B1 | 2/2001 | Fuchsbichler |
| 6,924,257 | B2 | 8/2005 | Klos et al. |
| 7,045,021 | B2 | 5/2006 | Ewing et al. |
| 7,134,781 | B2 | 11/2006 | Roberts et al. |
| 7,617,832 | B2 | 11/2009 | MacDowell |
| 2003/0085239 | A1 | 5/2003 | Crain et al. |
| 2006/0135394 | A1 | 6/2006 | Smith et al. |
| 2009/0139545 | A1 | 6/2009 | Rowlands et al. |
| 2010/0226835 | A1 | 9/2010 | Carroll et al. |

FOREIGN PATENT DOCUMENTS

| | | |
|---|---|---|
| EP | 0300819 | 5/1993 |
| EP | 0244153 | 1/1994 |
| EP | 0288918 | 11/1995 |
| EP | 0225859 | 10/1996 |
| GB | 2288191 | 10/1995 |
| WO | 9211929 | 7/1992 |
| WO | 9221808 | 12/1992 |
| WO | 9303217 | 2/1993 |
| WO | 9416805 | 8/1994 |
| WO | 9617543 | 6/1996 |
| WO | 9935078 | 7/1999 |
| WO | 2005110574 | 11/2005 |
| WO | 2006037354 | 4/2006 |
| WO | 2008077437 | 7/2008 |

* cited by examiner

DISSOLUTION GENERATOR, METHOD OF DISSOLVING POWDER, AND MIXING SYSTEM

CROSS-REFERENCE TO RELATED APPLICATIONS

This application claims the benefit of Provisional Patent Application No. 61/480,013, filed Apr. 28, 2011.

BACKGROUND OF THE INVENTION

This invention relates generally to fluid handing systems and more particularly to a system for mixing and diluting detergent components for spray washing equipment.

Various systems such as vehicle washes require liquid detergent mixed at a specific concentration for effectiveness, safety, and cost control. Typical detergents include alkaline material such as phosphates, silicates, and carbonates, as well as surfactants, perfume, and dyes. Such materials are commercially available at "drum strength", about 85% water, which is further diluted by the end user.

Shipping and handling drums (typically 55 gallon drums) of drum strength material is very expensive. These types of drums weigh about 230 kg (500 lbs.) and are difficult to handle and require too much floor space in most small mechanical rooms.

It is therefore known to use a two-part system in which dry powder and highly concentrated liquid, both containing as little water as possible, are produced and transported separately to the point of use in relatively small, easy-to-handle containers. They are then mixed and diluted with water at the point of use, to produce a ready-to-use detergent.

There are several ways to accomplish detergent mixing using devices such as concentration probes, photocells, and electronic control components. However, the manufacturing cost and liability of known methods are high.

Accordingly, there is a need for a detergent mixing system that does not rely on electronics, is easy to maintain, safe to service, and economical to produce.

BRIEF SUMMARY OF THE INVENTION

This need is addressed by the present invention, which provides a dissolution generator for dissolving powder into a liquid resulting in a solution with a constant concentration.

According to one aspect of the invention, a dissolution generator includes: an upright housing; a screen assembly extending across an interior of the housing, and configured to support a column of powder there above; a spray nozzle disposed below the screen assembly and directed towards the screen assembly; and a pressure mechanism disposed above the screen assembly, and configured to apply a substantially constant downward pressure.

According to another aspect of the invention, a method of dissolving powder into a liquid includes: placing a column of powder in a housing above a screen assembly; using a pressure mechanism to apply a substantially constant downward pressure to the column of powder above the screen assembly; and spraying liquid at the screen assembly of powder through a spray nozzle so as to dissolve an exposed portion of the powder.

According to another aspect of the invention, a method of making a product solution includes: placing a column of powder in a housing above a screen assembly; using a pressure mechanism to apply a substantially constant downward pressure to the column of powder above the screen assembly; receiving water from a water supply and spraying the water at the screen assembly of powder through a spray nozzle so as to dissolve an exposed portion of the powder, thereby producing a first solution; mixing a secondary fluid into the first solution so as to produce the product solution.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
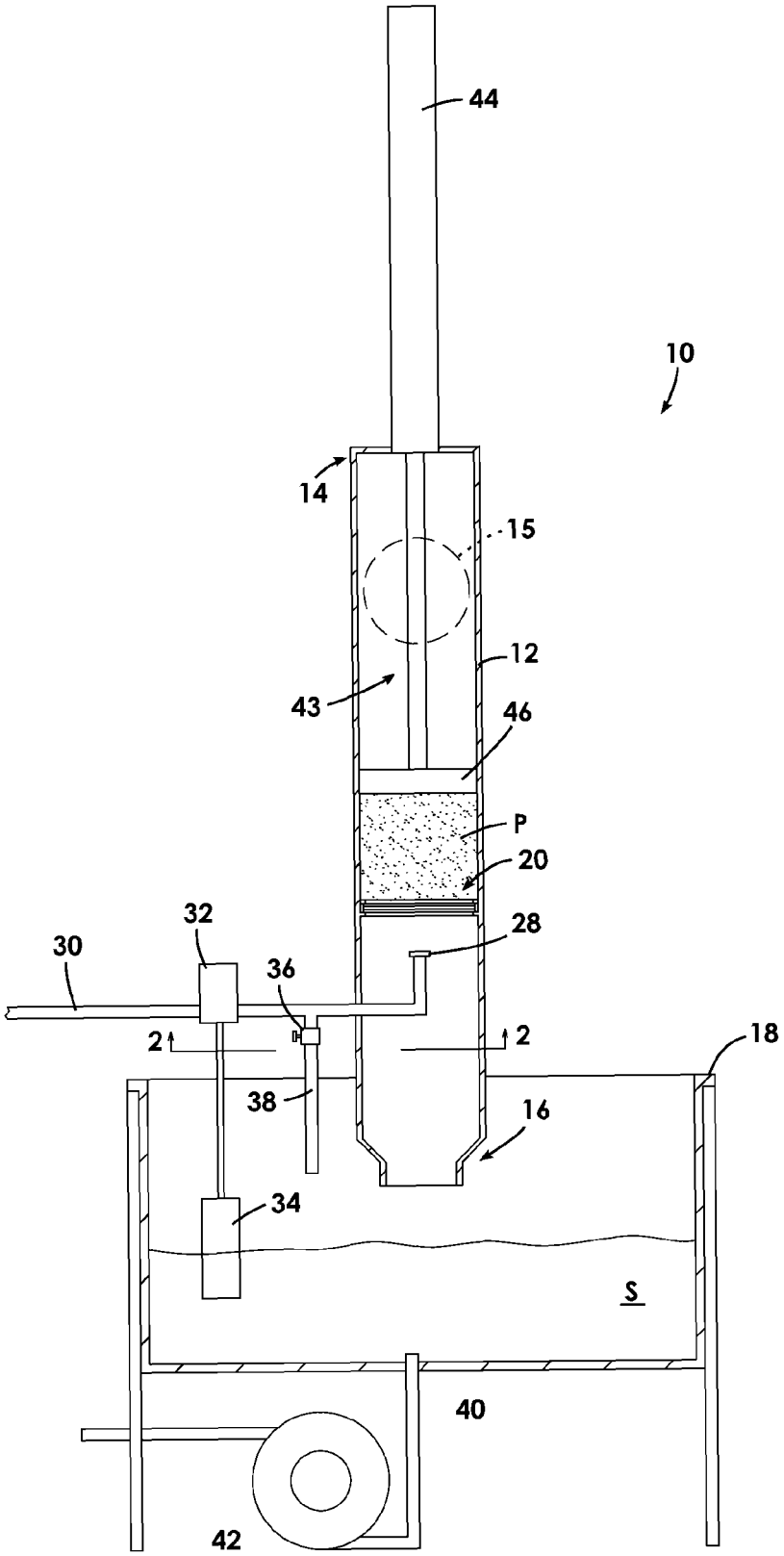
FIG. 1 is a partially cut-away schematic side view of a dissolution generator constructed according to an aspect of the present invention.

Referring to the drawings wherein identical reference numerals denote the same elements throughout the various views, FIG. 1 depicts an exemplary dissolution generator 10 constructed according to an aspect of the present invention. The dissolution generator 10 includes an upright housing 12 with upper and lower ends 14 and 16. In the illustrated example the housing 12 is cylindrical. An opening with a removable cover 15 (shown schematically in FIG. 1) may be provided so that powdered material "P" can be loaded into the housing 12. In a typical application, the powder P would be a known type of "soap builder", e.g. an alkaline material containing materials such as phosphates, silicates, and/or carbonates. The housing 12 is mounted above an open solution tank 18.

Figure 3:
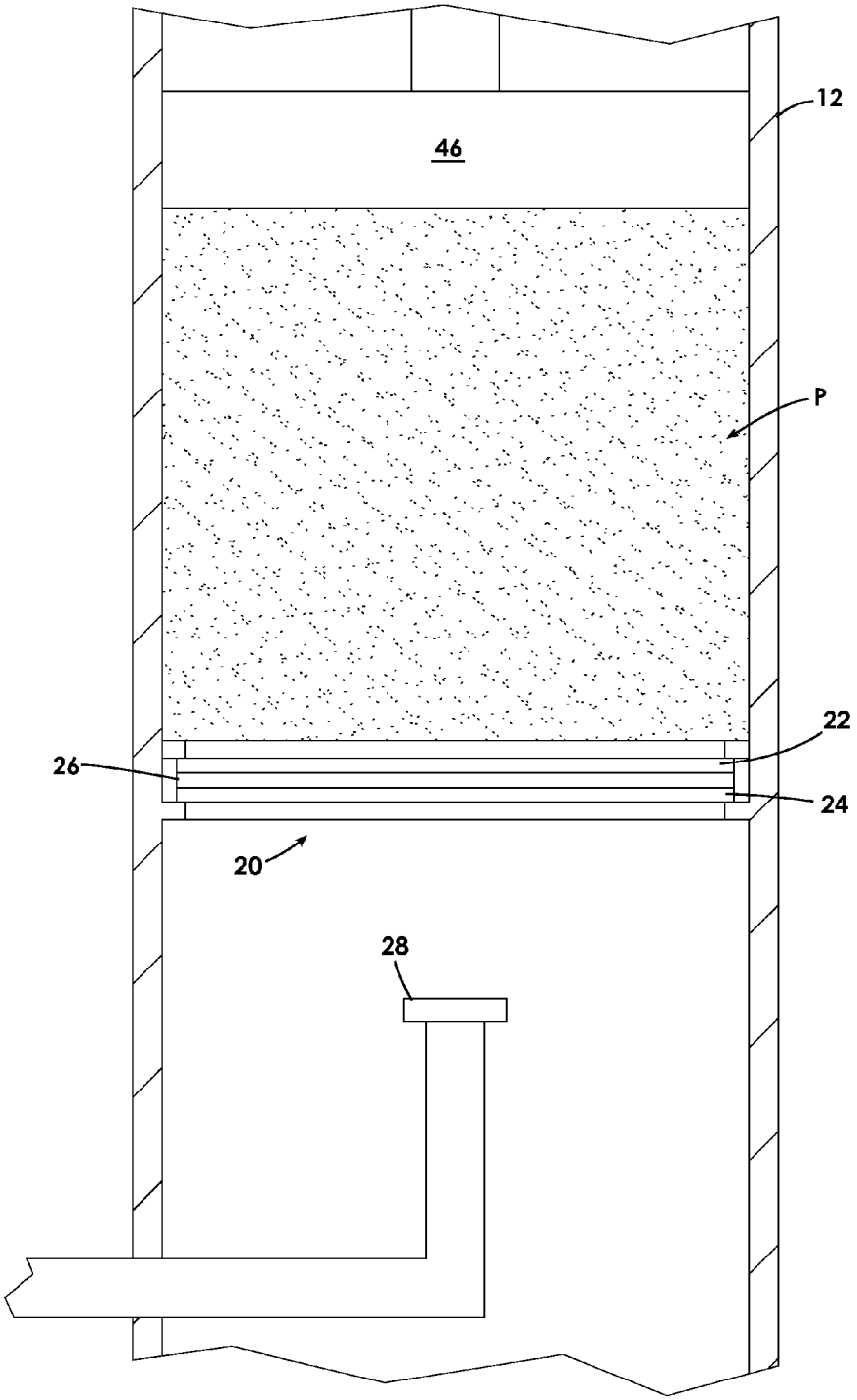
FIG. 3 is an enlarged view of a portion of FIG. 1.

A screen assembly 20 including one or more screens is mounted towards the lower end 14 of the housing 12. As used herein the term "screen" refers to any structure which extends across and blocks a passageway, and presents a controlled open area through a plurality of openings. Examples of structures that could be used for screens include dividers with patterns of holes or other apertures formed therein, fabric mesh or netting, or wire mesh grids. As best seen in FIG. 3, in the illustrated example there are two support screens 22 and 24 positioned above and below a metering screen 26, respectively, in effecting sandwiching the metering screen 26 between them. It will be understood that the screen assembly 20 need not contain all of these components and could comprise only a single screen. The support screens 24 and 24 provide structural support to the column of powder P within the housing 12. They have a heavier structure and more open area than the metering screen 26, in order to allow powder to pass through them freely while protecting the metering screen 26 from the full force of the powder column. The metering screen 26 has a open area substantially evenly distributed across its surface. The number and size of the passages in the metering screen 26 are selected to provide a desired dissolution rate.

Figure 2:
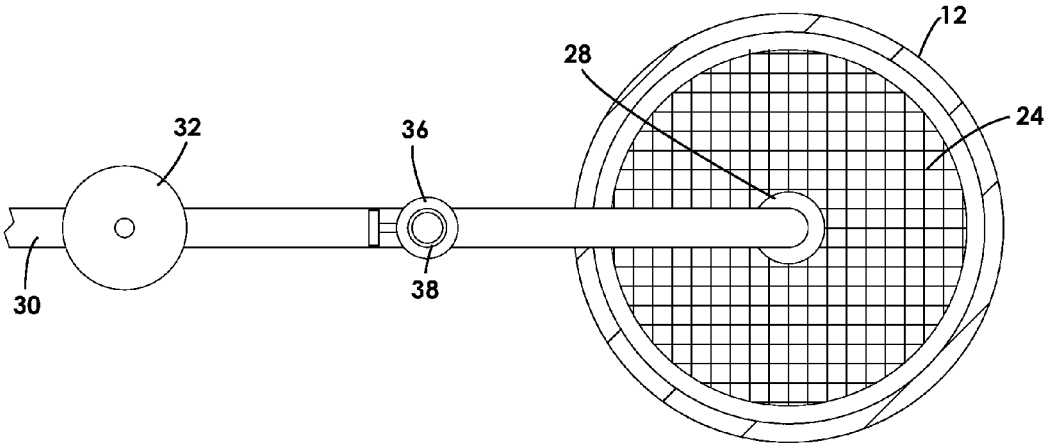
FIG. 2 is a view taken along lines 2-2 of FIG. 1.

As seen in FIGS. 1 and 2, a spray nozzle 28 is centrally mounted within the housing 12 beneath the screen assembly 20, pointing upwards at the screen assembly 20. The spray nozzle 28 is a type designed to produce a spray pattern evenly across the surface of the metering screen 26. A nonlimiting example of a suitable spray nozzle 28 is a spiral-type nozzle providing a solid-cone spray pattern with a round impact area. Such nozzles are commercially available from Spraying Systems Company, Wheaton, Ill. 60187, USA.

Figure 7:
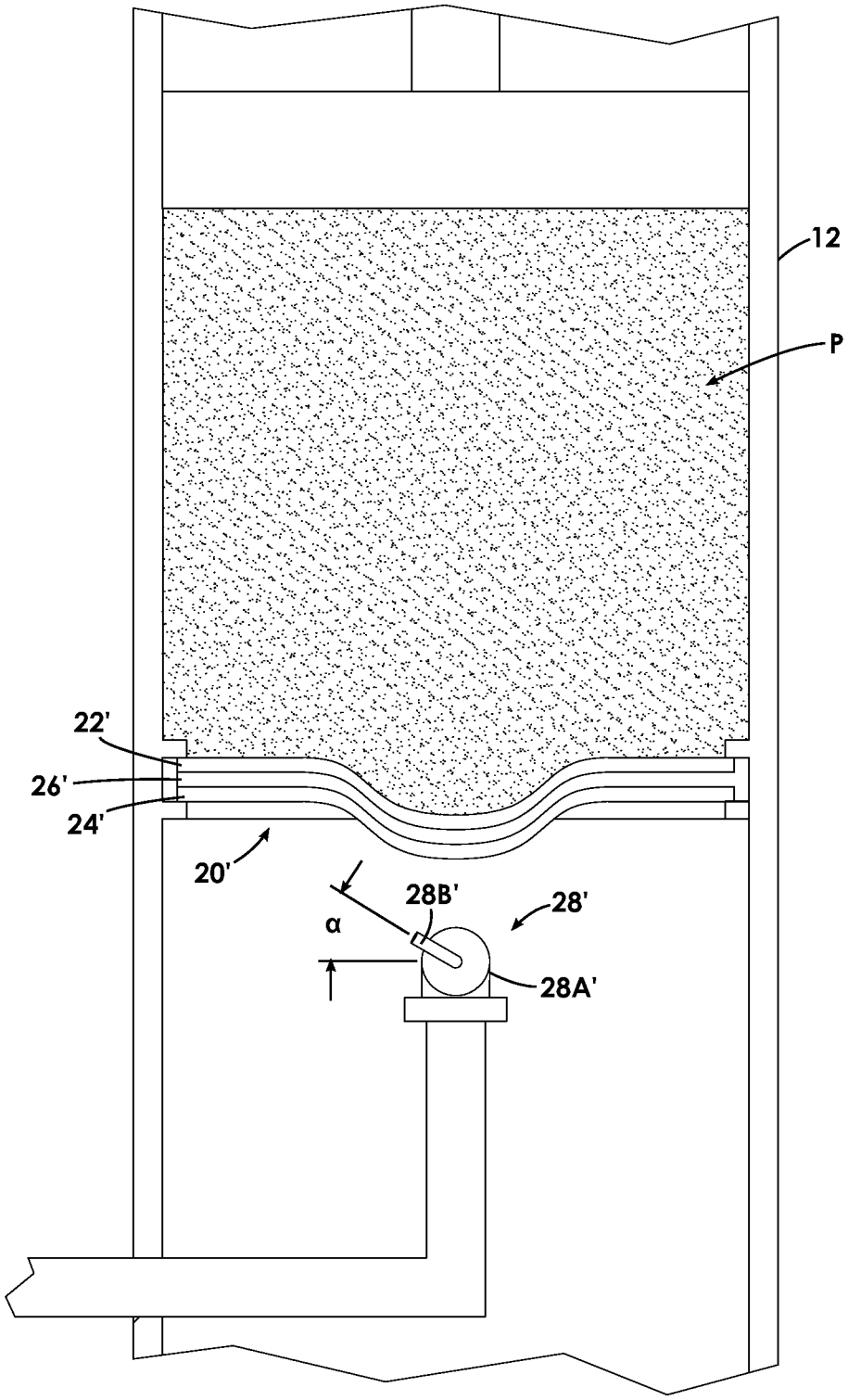
FIG. 7 is a cross-sectional view of an alternative screen assembly and spray nozzle for a dissolution generator.
Figure 8:
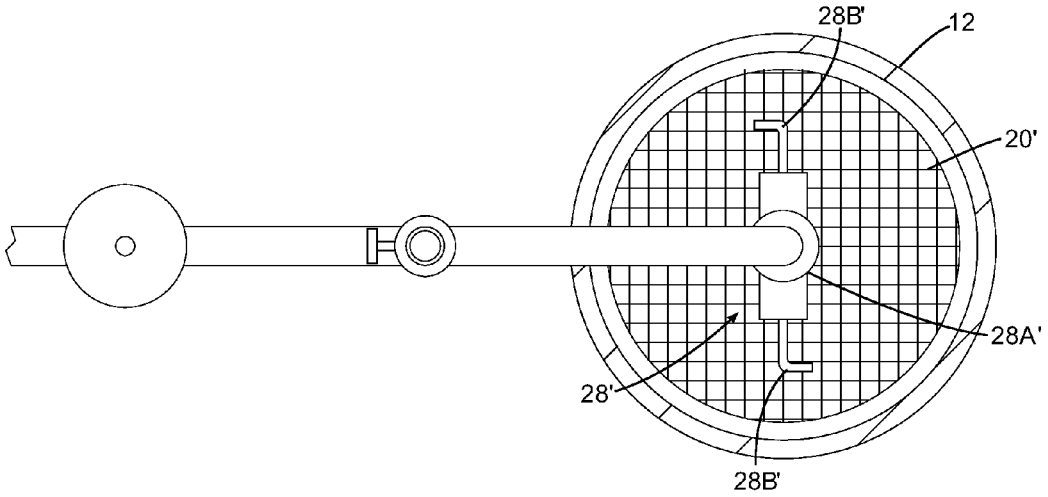
FIG. 8 is a bottom view of the screen assembly of FIG. 7.

FIGS. 7 and 8 illustrate a housing 12 containing an alternative screen assembly 20' and spray nozzle 28'. The screen assembly 20' is similar in construction to the screen assembly described above and includes two support screens 22' and 24' positioned above and below a metering screen 26', respectively, as described above. The screen assembly 20' differs from the screen assembly 20 in that the screens 22', 24', and 26' have a convex shape with a central portion that bulges downward towards the spray nozzle 28'.

The spray nozzle 28' is referred to as a "vortex" nozzle. The spray nozzle is centrally mounted within the housing 12 beneath the screen assembly 20', pointing upwards at the screen assembly 20'. The spray nozzle 28' includes a freely rotatable central hub 28A' with one or more L-shaped arms 28B' having discharge openings 28C' at their tips. The arms 28B' are oriented so as to produce a reaction force that rotates the spray nozzle 28' when water is discharged from them. The arms 28B' are angled towards the screen assembly 20' at an angle $\alpha$ measured from a plane perpendicular to the axis of rotation of the spray nozzle 28'. In operation, the spray nozzle 28' creates a rotating generally conical spray pattern or "vortex". This pattern, in combination with the shaping of the screen assembly 20' as described above, produces a "scrubbing" effect on the powder P and is useful in producing very high powder dissolution rates.

A supply line 30 from a pressurized water supply (such as a municipal water main) is connected to a main fill valve 32. In the illustrated example the main fill valve 32 is a float-type valve connected to a float 34. The main fill valve 32 opens when the float 34 drops below a specified setpoint and closes when the float 34 is at or above the setpoint. Downstream of the main fill valve 32, an adjustable bypass valve 36 is disposed in-line and connected to a bypass line 38. When the bypass valve 36 is closed, all flow passes to the spray nozzle 28. When the bypass valve 36 is opened, water can flow from the bypass line 38 directly into the solution tank 18. The bypass valve 36 is infinitely adjustable from zero to its maximum flow. The solution tank 18 has a drain line 40 and a pump 42 coupled thereto.

A pressure mechanism 43 is mounted in the housing 12 above the screen assembly 20. The pressure mechanism 43 is effective to apply a substantially constant downward pressure to the column of powder above the screen assembly 20. In the illustrated example, the pressure mechanism comprises a pneumatic cylinder 44 mechanically coupled to a piston 46 which slides in the interior of the housing 12. When air is supplied to the pneumatic cylinder 44, the piston 46 extends downward. Other mechanisms effective to apply a substantially constant pressure could be substituted for the pneumatic cylinder 44, such as a hydraulic cylinder, a mechanical or electromechanical press, or one or more weights.

Figure 6:
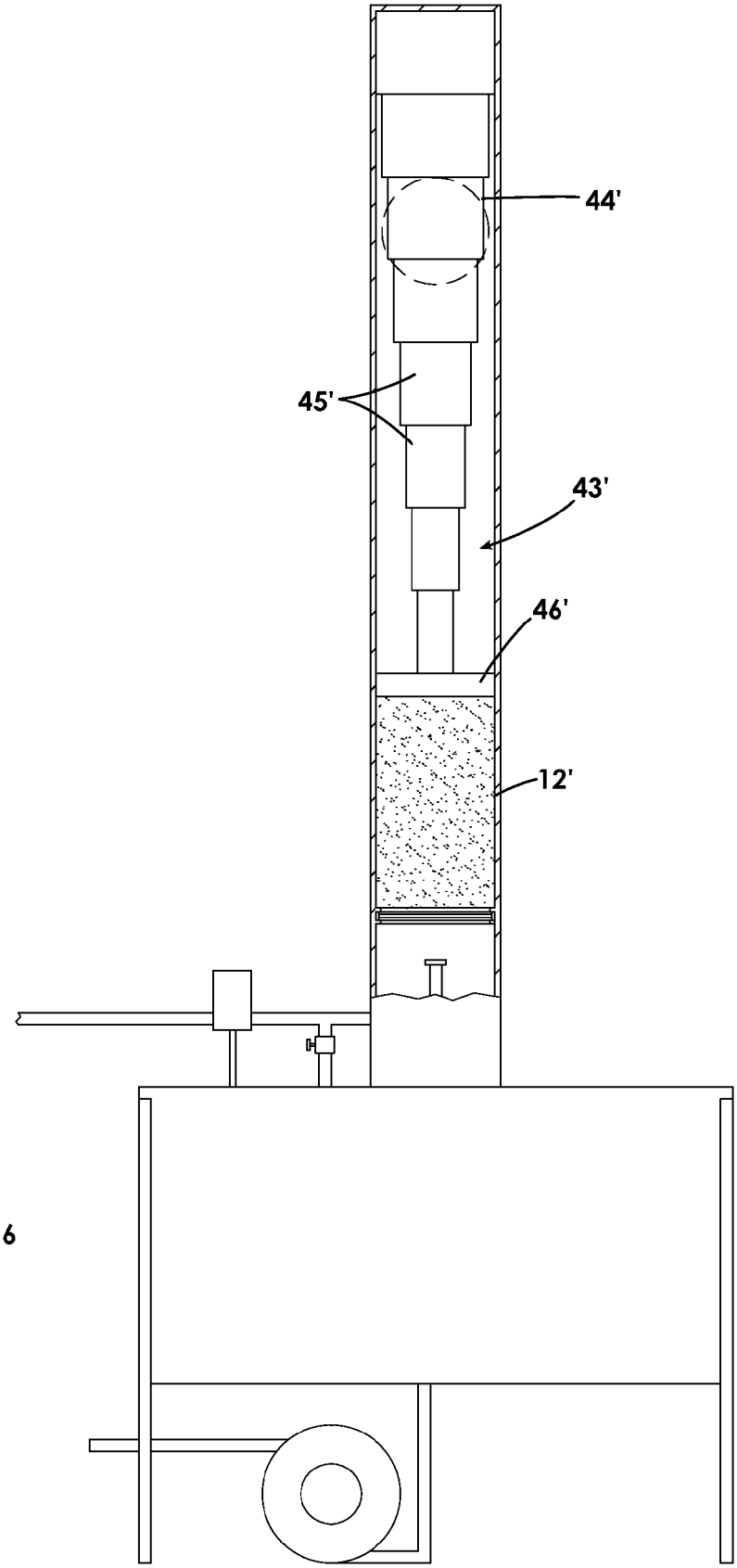
FIG. 6 is a partially cut-away schematic side view of a dissolution generator incorporating a telescoping pressure mechanism.

FIG. 6 illustrates an alternative pressure mechanism 43' that may be used with the dissolution generator 10. The pressure mechanism 43' includes a pneumatic cylinder 44' coupled to a piston 46' and disposed inside a housing 12'. The pneumatic cylinder 44' is a commercially-available telescoping type with a plurality of sections 45' that telescope into each other when the piston 46' is raised. As compared to a non-telescoping cylinder, this type of pressure mechanism 43' can accommodate a larger amount of powder P within the same size of housing, or allow a smaller housing for a given amount of powder P.

The dissolution generator 10 operates as follows. The housing 12 is loaded with powder P. The pressure mechanism 43 is activated which pressurizes the column of powder P and ensures that it fills the complete area of the screen assembly 20. The main fill valve 32 is supplied with pressurized water. When the float 34 is below the setpoint (for example, when starting with the solution tank 18 empty), the main fill valve 32 opens and water sprays from the spray nozzle 28 across the entire face of the screen assembly 20. The water washing across the screen assembly 20 dissolves the exposed powder P, and the resulting solution "S" falls into the solution tank 18. The fill valve 32 stays open until the solution level in the solution tank 18 reaches the setpoint.

Examples of factors which affect the concentration of the solution S include the distance between the spray nozzle 28 and the metering screen 26, the surface area of the metering screen 26, the temperature of the water from the spray nozzle 28, the water pressure, and the size of the openings in the metering screen 26. These factors may be adjusted through routine experimentation to arrive at a desired concentration. If desired, the bypass valve 36 may be opened to flow additional water into the solution tank 18 to control the solution strength. Unlike prior art devices, the dissolution generator 10 of the present invention provides a substantially constant concentration of the solution S as it drops from the housing 12 and enters the solution tank 18. This means that solution S can be drained from the solution tank 18 whenever it is needed, without regard to the operating cycle of the dissolution generator 10. The dissolution generator 10 does not need to be operated in a "batch" process to obtain a specific concentration. Nor are any sophisticated sensors needed to control the concentration once the device is initially calibrated.

Figure 5:
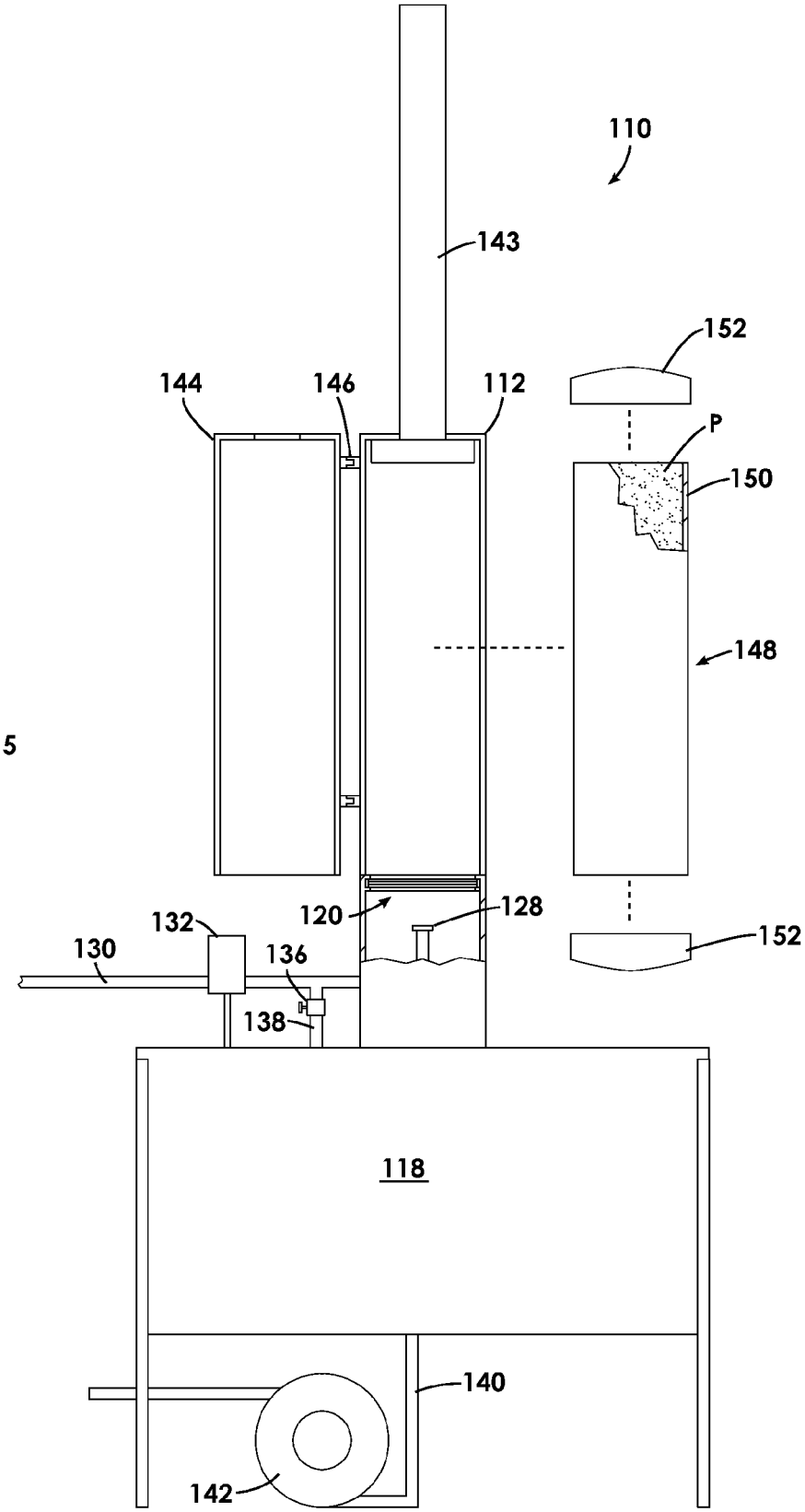
FIG. 5 is a partially cut-away schematic side view of an alternative dissolution generator.

FIG. 5 illustrates an alternative dissolution generator 110 similar in construction to the dissolution generator 10 described above. It includes an upright housing 112, a pressure mechanism 143, a screen assembly 120, a spray nozzle 128, a supply line 130, a main fill valve 132 connected to a float, an adjustable bypass valve 136, a bypass line 138, a solution tank 118, a drain line 140 and a pump 142.

The housing 112 incorporates a panel or door 144 that can be opened and closed to expose the interior of the housing 112. In the illustrated example, the door 144 is mounted on hinges 146. The housing 112 can accept pre-packed tubes or "cartridges" 148 of powdered product. The cartridges 148 can be either disposable or reusable in nature. As seen in FIG. 5, the cartridge 148 has a sidewall 150 with a closed perimeter. The distal ends of the sidewall 150 are open. In the illustrated example, the sidewall 150 is generally cylindrical. Powdered product P is packed inside the sidewall 150. The sidewall 150 could be constructed from a variety of materials such as cardboard, plastic, or metal. The product P may be compressed and/or treated with a binder as needed to retain it in the cartridge 148. End caps 152 may be placed over the ends of the cartridge 148 to retain the product P and prevent exposure prior to use. The cartridges 148 are used by opening the door 144, removing the end caps 152, and placing the cartridge 148 into the housing 112. The door 144 is then closed, and may be secured with latches or fasteners (not shown). Operation of the dissolution generator 110 is then as described for the dissolution generator 10 described above. During operation the piston of the pressure mechanism 143 moves the product P down through the cartridge 148. When the cartridge 148 is empty, the piston can be retracted, the door 144 opened, and then the cartridge 148 can be removed for disposal or reuse.

Use of the cartridges 148 greatly reduces human exposure to the product P itself either by skin contact or inhalation. These cartridges 148 also keep contamination from entering the product P from the surrounding environment. The use of the cartridges 148 can also greatly reduce the error that can occur during batch weighing P. Weighing of the product P can occur in a more controlled environment and product dispensed in the field with a calibrated dissolution generator.

Figure 4:
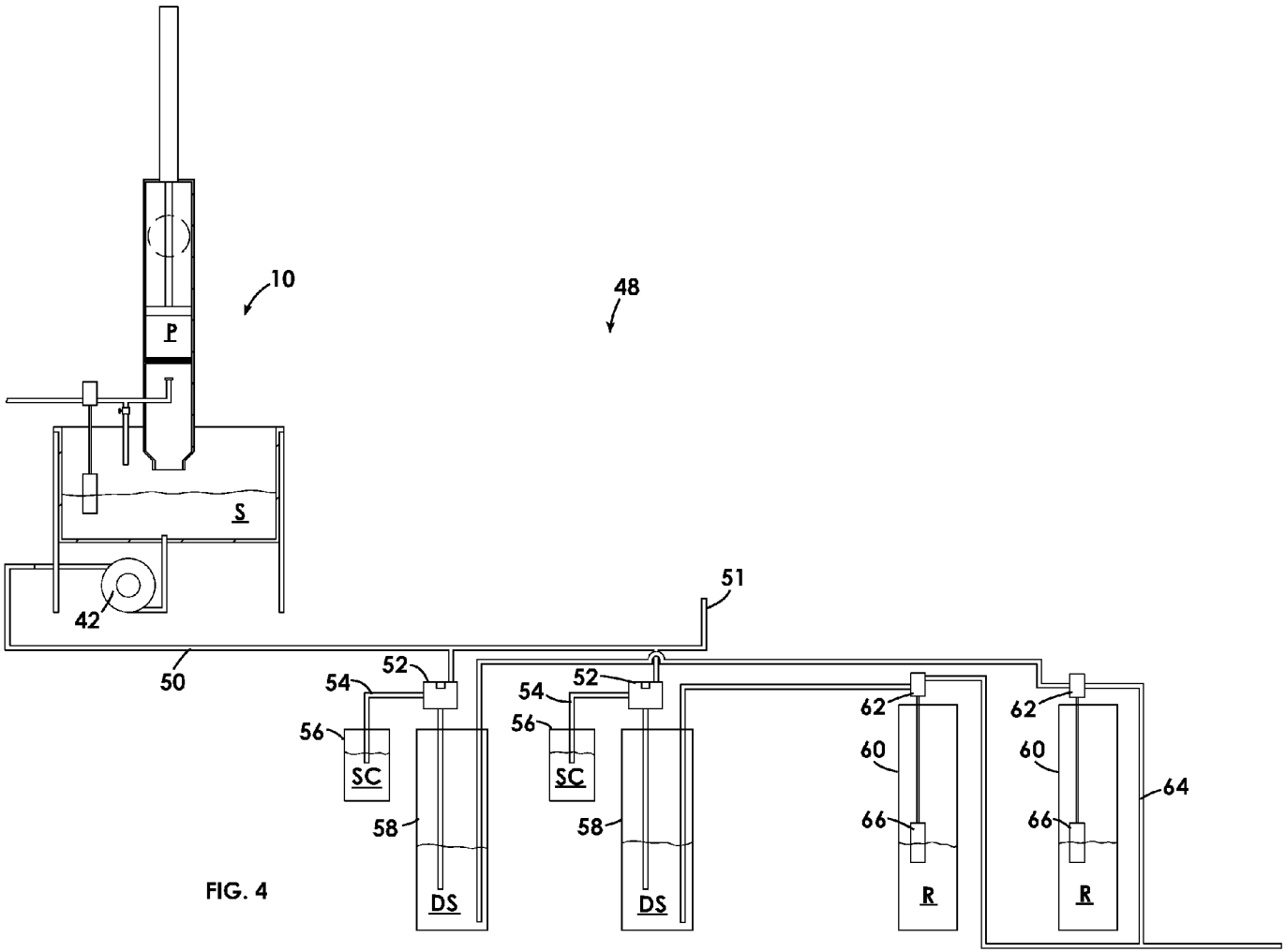
FIG. 4 is a schematic diagram of a detergent system incorporating the dissolution generator of FIG. 1.

FIG. 4 illustrates a detergent system 48 incorporating the dissolution generator 10 of the present invention. The detergent system 48 can be generically considered to be a mixing system. The detergent system 48 would typically be used to supply detergent and various cleaning chemicals to an automatic or manual vehicle washing system of a known type, but it may be used in any situation where liquids of known concentration are required. The detergent system 48 includes a pipe manifold 50 coupled to the pump 42 which feeds metering devices 52. The manifold 50 may include an addition feed line 51 which may be used to supply the solution S directly to a user (for example, for use as a very strong engine degreaser or tire cleaner). While any type of device capable of accurately metering one fluid into another at a selected ratio may be used, in the illustrated example the metering devices 52 are commercially available "button proportioners". These use an eductor principle in which a working fluid provides the energy to draw a secondary fluid through an orifice and mix it with the working fluid at a known ratio of the flow rate of the secondary fluid to the flow rate of the working fluid. Draw tubes 54 extend from the metering devices 52 into supply containers 56 which contain liquid components. The metering devices 52 discharge into solution tanks 58. In this case the working fluid is the pressurized solution S from the solution tank 18. The secondary fluid is the fluid contained in the supply containers 56. In a typical system intended for vehicle washing, the secondary fluid would be superconcentrate or "SC" of a known type containing components such as surfactants, perfumes, dyes, and the like.

Wash tanks 60 are disposed downstream of the dilution tanks 58. Each wash tank 60 is provided with a metering device 62. The metering devices 62 draw diluted solution (also known as "drum strength" solution), labeled "DS", from the dilution tanks 58 and dilute it at a predetermined ratio with water from a pressurized water supply 64, to arrive at a ready-to-use solution "R" in the wash tanks 60. In the illustrated example the metering devices 60 are commercially available float-activated proportioner which are activated when an attached float 66 is below a setpoint and deactivate when the float is at or above a setpoint. This solution R may be pumped or drained from the wash tanks 60 as needed for use.

The illustrated example shows two dilution tanks 58 and two wash tanks 60. It will be understood that a detergent system could include any number of dilution tanks 58 and any number of wash tanks 60 as needed to suit a particular application. The dilution tanks 58 may be used to feed wash tanks 60, or the solution DS from the dilution tanks 58 may be provided directly to a wash user (for example, for use as a very strong engine degreaser or tire cleaner). Multiple dilution tanks 58 may be used to supply the same diluted solution DS to several wash tanks 60, or each dilution tank 58 may be used to mix the solution S from the solution tank 18 with different types of chemicals.

Figure 9:
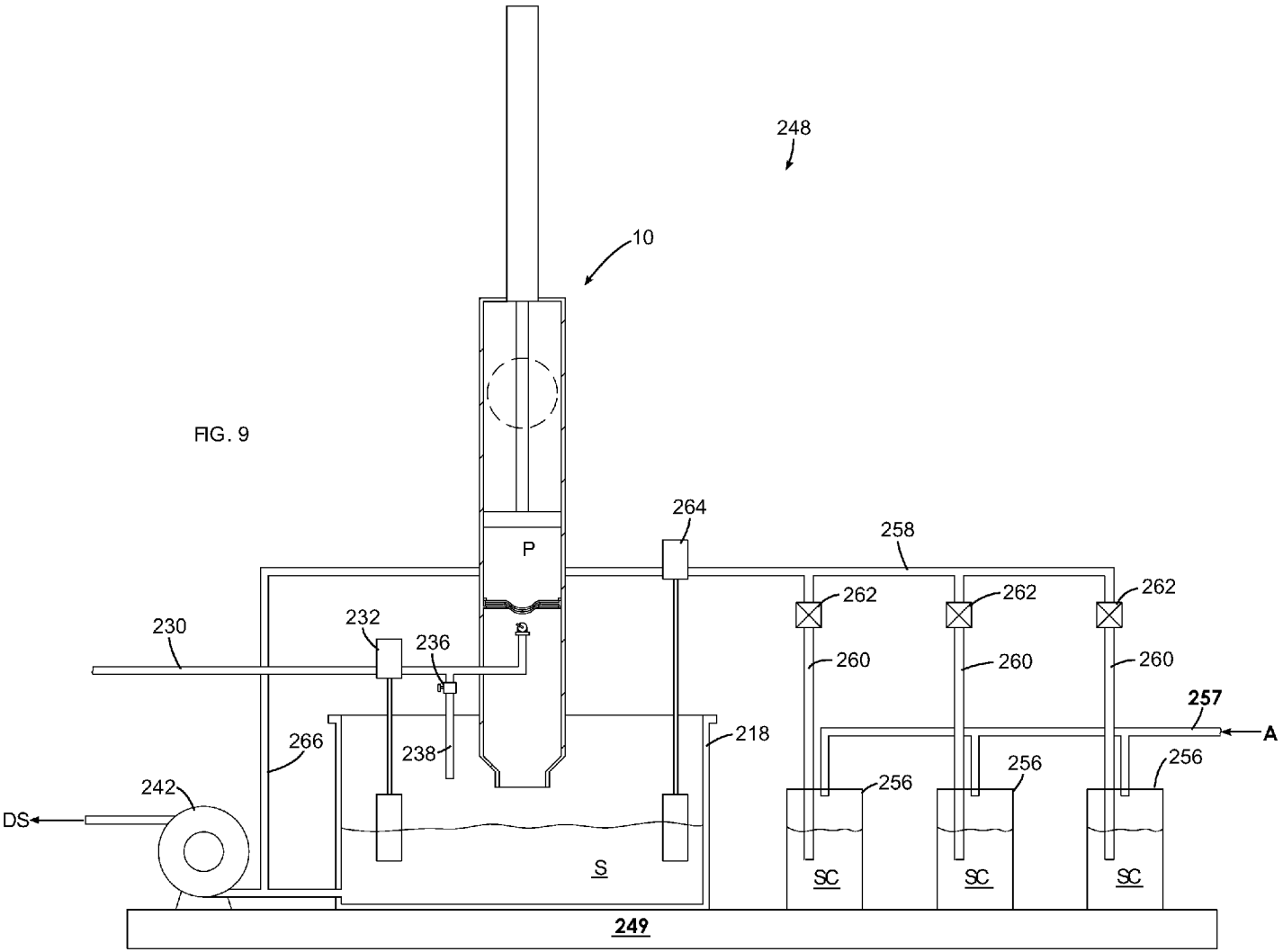
FIG. 9 is a schematic diagram of a mobile blending system incorporating a dissolution generator.

FIG. 9 illustrates a mobile blending system 248 incorporating a dissolution generator 10 constructed according to the present invention. The mobile blending system 248 can be generically considered to be a mixing system. All of the components of the mobile blending system 248 are mounted to a common frame 249, and it may be mounted on a conventional wheeled chassis so that it can be easily transported to a customer premises. The dissolution generator 10 may incorporate any of the options and features described above. In the illustrated example, the dissolution generator 10 incorporates the vortex-type nozzle and accompanying screen assembly described above.

The mobile blending system 248 includes a mixing pump 242 with its inlet coupled to the solution tank 218 of the dissolution generator 10. A supply line 230 is provided which is connected to a pressurized water supply (not shown). The supply line 230 is connected to a first float-type fill valve 232 of the type described above. Downstream of the main fill valve 232, an adjustable bypass valve 236 is disposed in-line and connected to a bypass line 238.

The blending system 248 includes one or more supply containers 256 each containing a secondary fluid or blend of secondary fluids. In a typical system intended for vehicle washing, each secondary fluid would be superconcentrate or "SC" of a known type containing components such as surfactants, perfumes, dyes, and the like. The supply containers 256 may be pressurized by air delivered from an air manifold 257 which is in turn connected to a source of pressurized air "A" such as an air compressor or an air tank (not shown). Each of the supply containers 256 is coupled to a supply manifold 258 by a draw pipe 260 and a valve 262. The supply manifold 258 is connected to a second float-type fill valve 264 which is in turn coupled to the inlet of the mixing pump 242 by a line 266.

In operation, the dissolution generator 10 receives water from the supply line 230. The water may be supplied by a customer. The dissolution generator 10 effective to dissolve the powder P in the water and thereby produce a solution S as described above. This solution is drawn into the inlet of the mixing pump 242. Simultaneously, superconcentrate SC is transferred from the supply containers 256 through the supply manifold 258 to the inlet of the mixing pump 242. The level of solution S in the mixing tank 18 controls the cycling of both the first and second fill valves 232 and 264. While only one dissolution generator 10 is illustrated, it will be understood that the blending system 248 may incorporate as many dissolution generators 10 as required to produce solution S at the needed rate. The discharge product of the mixing pump 242 is drum strength solution DS. The drum strength solution DS (which is a final product or final solution) may be pumped into containers such as drums or other equipment located at the customer premises. Notably in contrast to the prior art, the blending system 248 may be used to prepare only the amount of drum strength solution DS required by a customer at a particular time, and may be used to "top off" a customer's tanks.

The blending system 248 is "on-demand" and allows the blending and transfer of product using on-site water. Only the powder P and the superconcentrate SC have to be transported with the blending system 248. These products can be formulated so as to contain almost no water, avoiding its bulk and mass. The end user only purchases the drum strength product and does not have to move, exchange, or dispose of containers.

Figure 10:
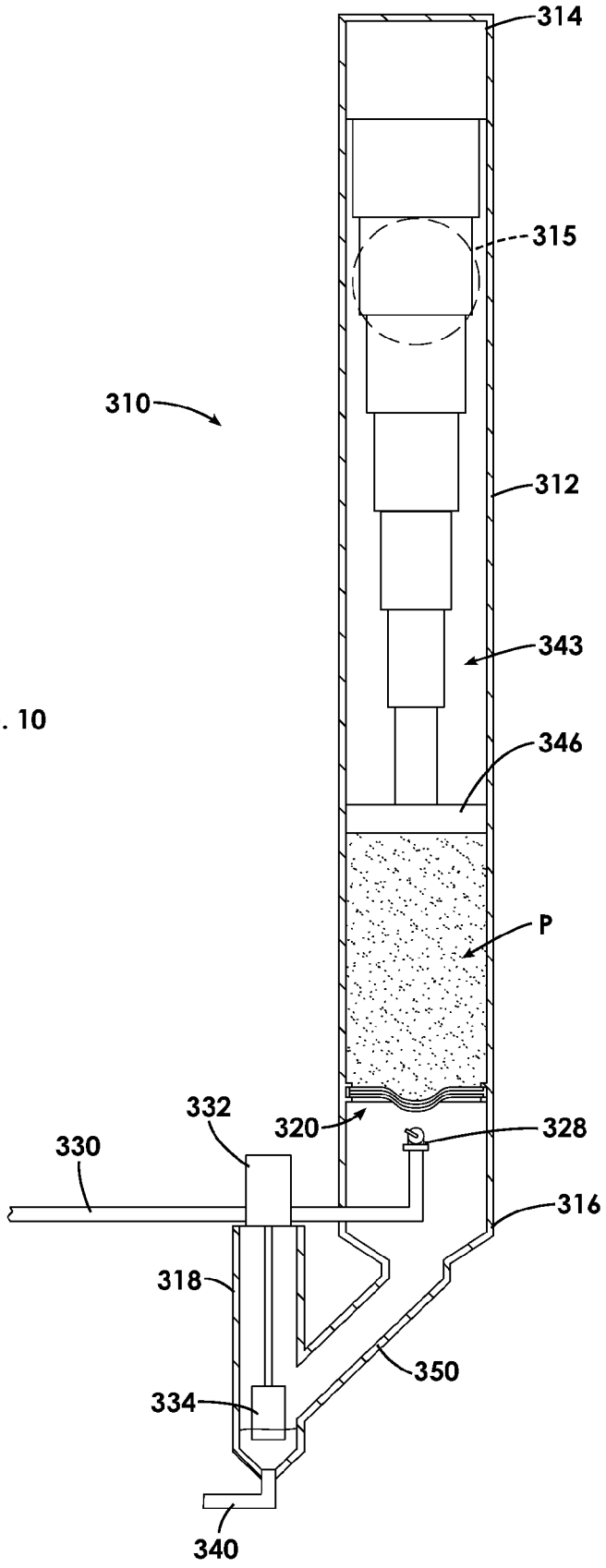
FIG. 10 is a cross-sectional view of an on-demand dissolution generator constructed according to an aspect of the present invention.

FIG. 10 depicts an "on-demand" dissolution generator 310. The dissolution generator 310 is similar in construction to the dissolution generator 310. It includes an upright housing 312 with upper and lower ends 314 and 316. An opening with a removable cover 315 (shown schematically in FIG. 10 may be provided so that powdered material "P" can be loaded into the housing 312.

A pressure mechanism 343 is mounted in the upper in 314 of the dissolution generator 310. The pressure mechanism 343 is of the telescoping type described above and includes a piston 346.

A screen assembly 320 is mounted beneath the pressure mechanism 343. In this example the screen assembly 320 is convex-curved with a bulged central portion as described above. A vortex-type spray nozzle 328 is mounted below the screen assembly 320. A solution tank 318 is disposed laterally adjacent to and slightly below the lower end 316 of the housing 312. The solution tank 318 is coupled to the lower end 316 of the housing 312 by a duct 350.

A supply line 330 from a pressurized water supply (not shown) is connected to a fill valve 332. In the illustrated example the fill valve 332 is a float-type valve connected to a float 334. The float 334 is disposed in the lower end of the solution tank 318. A discharge line 340 is connected to the bottom end of the solution tank 318 below the float 334.

The dissolution generator 310 depicted in FIG. 10 is capable of rapidly dissolving large amounts of powder P into water, thereby generating solution S at high rates. Therefore, it does not require a significant buffer volume in order to provide solution S at the rate required by a downstream process. As a result, the dissolution generator 310 can be configured to incorporate a minimal amount of volume below the screen assembly 320, including the lower end 316 of the housing 312, the duct 350, in the solution tank 318.

This characteristic is helpful when the downstream process requires a liquid having large particles or molecules entrained therein. Such particles or molecules would ordinarily tend to fall out of solution or separate if they experience any significant residence time within mixing equipment. The dissolution generator 310 is able to rapidly create solution S containing such particles or molecules and deliver it as needed. For example, cleaning solutions containing zeolites may be produced using the dissolution generator 310 and delivered directly to an injector or spray nozzle, where they can be used before their effectiveness degrades.

The foregoing has described a dissolution generator, related mixing systems, and a method for their use. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only.

What is claimed is:

1. A dissolution generator, comprising:

an upright housing;

a screen assembly extending across an interior of the housing, and configured to support a column of powder thereabove;

a spray nozzle disposed below the screen assembly and directed to spray towards the screen assembly; and a pressure mechanism disposed above the screen assembly, and configured to apply a substantially constant downward pressure to the column of powder.

2. The dissolution generator of claim 1 wherein the screen assembly comprises:

a metering screen having a first open area; and support screens disposed above and below the metering screen, each of the support screens having a second open area greater than the first open area.

3. The dissolution generator of claim 1 wherein the spray nozzle is a static nozzle configured to discharge a cone-shaped spray pattern.

4. The dissolution generator of claim 1 wherein the spray nozzle comprises:

a freely rotatable central hub; and one or more spray arms extending from the central hub, the spray arms configured and oriented so as to produce a reaction force that rotates the spray nozzle in response to water being discharged therefrom.

5. The dissolution generator of claim 1 wherein the screen assembly has a convex shape with a central portion that bulges downward towards the spray nozzle.

6. The dissolution generator of claim 1 further comprising:

a solution tank disposed below the housing so as to receive solution discharged from the housing.

7. The dissolution generator of claim 6 further comprising:

a fill valve coupled between a supply line and the spray nozzle; and a float disposed in the solution tank and coupled to the fill valve, wherein the fill valve is configured to open when the flow drops below a setpoint and close when the float is at or above the setpoint.

8. The dissolution generator of claim 1 wherein the pressure mechanism comprises a piston disposed above the screen assembly and slidable in the housing.

9. The dissolution generator of claim 1 wherein the pressure mechanism comprises a telescoping piston-cylinder apparatus comprising a plurality of sections.

10. The dissolution generator of claim 1 wherein the housing includes a door movable between open and closed positions, the open position exposing an interior of the housing between the screen assembly and the pressure mechanism.

11. The dissolution generator of claim 10 in combination with a cartridge, comprising:

a sidewall with a closed perimeter and open distal ends;

a powdered product packed inside the sidewall.

12. A mixing system comprising:

the dissolution generator of claim 1;

a solution tank disposed so as to receive solution discharged from the housing;

at least one metering device connected between the solution tank and a dilution tank;

at least one supply container configured to store the secondary fluid and coupled to the metering device, wherein the metering device is configured to meter the secondary fluid into the dilution tank.

13. A mixing system comprising:

the dissolution generator of claim 1;

a solution tank disposed so as to receive solution discharged from the housing;

a mixing pump having an inlet coupled to the solution tank;

at least one supply container configured to store a secondary fluid and coupled to the inlet of the mixing pump.

14. The mixing system of claim 13 further comprising:

a water supply coupled to the spray nozzle through a first fill valve having a first float disposed in the mixing tank; and a supply manifold coupled between the at least one supply container in the inlet of the mixing pump through a second fill valve having a second float disposed in the mixing tank.

15. A method of dissolving powder into a liquid, comprising:

placing a column of powder in a housing above a screen assembly;

using a pressure mechanism to apply a substantially constant downward pressure to the column of powder above the screen assembly; and spraying liquid at the screen assembly of powder through a spray nozzle so as to dissolve an exposed portion of the powder.

16. The method of claim 15 wherein the liquid is discharged through a static spray nozzle with a cone-shaped spray pattern.

17. The method of claim 16 wherein the liquid is discharged through a rotating spray nozzle which discharges a vortex spray pattern.

18. The method of claim 17 wherein the screen assembly has a convex shape with a central portion that bulges downward towards the spray nozzle.

19. The method of claim 15 wherein the liquid with the powder dissolved therein is discharged from the housing into a solution tank.

20. The method of claim 15 wherein the pressure is applied by a pneumatic piston.

21. The method of claim 15 further comprising, prior to spraying the powder, inserting a cartridge into the housing, the cartridge comprising:

a sidewall with a closed perimeter and open distal ends;

a powdered product packed inside the sidewall.

22. The method of claim 15 further comprising:

discharging the solution into a solution tank;

metering a secondary fluid from a supply container into the dilution tank.

23. A method of making a product solution, comprising:

placing a column of powder in a housing above a screen assembly;

using a pressure mechanism to apply a substantially constant downward pressure to the column of powder above the screen assembly;

receiving water from a water supply and spraying the water at the screen assembly of powder through a spray nozzle so as to dissolve an exposed portion of the powder, thereby producing a first solution;

mixing a secondary fluid into the first solution so as to produce the product solution.

24. The method of claim 23 further comprising immediately transferring the product solution to a downstream process.

* * * * *